US011536132B2

(12) United States Patent
Xia et al.

(10) Patent No.: US 11,536,132 B2
(45) Date of Patent: Dec. 27, 2022

(54) INTEGRATED MULTIPLE PARAMETER SENSING SYSTEM AND METHOD FOR LEAK DETECTION

(71) Applicant: Halliburton Energy Services, Inc., Houston, TX (US)

(72) Inventors: Hua Xia, Huffman, TX (US); Clovis S. Bonavides, Houston, TX (US); Avinash V. Taware, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 486 days.

(21) Appl. No.: 15/523,216

(22) PCT Filed: Dec. 31, 2014

(86) PCT No.: PCT/US2014/073072

§ 371 (c)(1),
(2) Date: Apr. 28, 2017

(87) PCT Pub. No.: WO2016/108914

PCT Pub. Date: Jul. 7, 2016

(65) Prior Publication Data

US 2017/0350234 A1 Dec. 7, 2017

(51) Int. Cl.

| | |
|---|---|
| ***E21B 47/10*** | (2012.01) |
| ***E21B 47/06*** | (2012.01) |
| ***E21B 47/12*** | (2012.01) |

(52) U.S. Cl.

CPC ..... *E21B 47/10* (2013.01); *E21B 47/06* (2013.01); *E21B 47/12* (2013.01)

(58) Field of Classification Search

CPC ..... E21B 47/10; E21B 47/06; E21B 47/12
See application file for complete search history.

(56) References Cited

U.S. PATENT DOCUMENTS 4,293,934 A * 10/1981 Herolz ..... G01V 1/46 346/33 WL
4,547,691 A 10/1985 Valdois et al.
(Continued)

FOREIGN PATENT DOCUMENTS

| | | |
|---|---|---|
| WO | WO 2009/009437 A2 | 1/2009 |
| WO | WO 2013/102252 A1 | 7/2013 |
| WO | WO 2014/100269 A1 | 6/2014 |

OTHER PUBLICATIONS

Extended Search Report issued for European Patent Application No. 14909710, dated Apr. 24, 2018, 8 pages.
(Continued)

*Primary Examiner* — Christopher J Sebesta
(74) *Attorney, Agent, or Firm* — John Wustenberg; C. Tumey Law Group PLLC

(57) ABSTRACT

A multiple parameter sensing leak detection system may include one or more multi-parameter sensing modules capable of simultaneously measuring downhole temperature, pressure, and acoustic signals. The temperature and pressure detectors may include quartz based sensing elements, and the acoustic detector may include piezoelectric based sensing elements. In one or more embodiments, a plurality of sensing modules may be carried on a caliper for allowing radial identification of leak location. In one or more embodiments, multiple calipers, each carrying a circumferential arrangement of sensing modules may be used to identify annular or inter-annular leakage beyond production tubing using triangulation techniques. A leak analysis method identifies if relative pressure and temperature variation amplitudes fall outside leak thresholds and if power spectral density from noise has anomalous frequency sig-
(Continued)

natures. A leak event may be identified by relative pressure and temperature variation amplitude and verified by power spectral density variation.

17 Claims, 10 Drawing Sheets

(56) References Cited

U.S. PATENT DOCUMENTS

| | | | | |
|---|---|---|---|---|
| 5,130,950 | A | 7/1992 | Orban et al. | |
| 6,026,913 | A | 2/2000 | Mandal et al. | |
| 6,298,724 | B1 | 10/2001 | Burgass et al. | |
| 7,104,116 | B2 | 9/2006 | Discenzo | |
| 7,122,152 | B2 | 10/2006 | Lewis et al. | |
| 7,219,762 | B2 | 5/2007 | James et al. | |
| 7,299,678 | B2 | 11/2007 | Atherton | |
| 7,334,483 | B2 | 2/2008 | Sato et al. | |
| 7,350,367 | B2 | 4/2008 | Matsiev et al. | |
| 7,477,993 | B2 | 1/2009 | Sunshine et al. | |
| 7,712,527 | B2 | 5/2010 | Roddy | |
| 7,779,700 | B2 | 8/2010 | Motoyama | |
| 7,870,791 | B2 | 1/2011 | Hedtke et al. | |
| 7,954,383 | B2 | 6/2011 | Willcox et al. | |
| 8,326,540 | B2 | 12/2012 | Hull et al. | |
| 8,340,911 | B2 | 12/2012 | Sorrells et al. | |
| 8,718,956 | B2 | 5/2014 | Hesketh et al. | |
| 8,736,281 | B2 | 5/2014 | Lowe et al. | |
| 2002/0124633 | A1 | 9/2002 | Yang et al. | |
| 2005/0016276 | A1 | 1/2005 | Guan et al. | |
| 2007/0084277 | A1* | 4/2007 | Steinsiek | E21B 47/101 73/152.18 |
| 2009/0101337 | A1* | 4/2009 | Neidhardt | E21B 47/08 166/250.01 |
| 2009/0326826 | A1 | 12/2009 | Hull et al. | |
| 2010/0064775 | A1 | 3/2010 | Ben-Mansour | |
| 2010/0268489 | A1* | 10/2010 | Lie | E21B 47/101 702/51 |
| 2011/0093220 | A1 | 4/2011 | Yang et al. | |
| 2011/0128003 | A1 | 6/2011 | Thompson et al. | |
| 2011/0188346 | A1 | 8/2011 | Hull | |
| 2011/0192592 | A1 | 8/2011 | Roddy et al. | |
| 2012/0253680 | A1* | 10/2012 | Thompson | G01V 11/007 702/13 |
| 2013/0031956 | A1 | 2/2013 | Mecea | |
| 2013/0134981 | A1 | 5/2013 | Liu et al. | |
| 2013/0167628 | A1 | 7/2013 | Hull et al. | |
| 2013/0257628 | A1 | 10/2013 | Smithson | |
| 2013/0333774 | A1 | 12/2013 | Downie et al. | |
| 2013/0340859 | A1 | 12/2013 | Downie | |
| 2014/0036627 | A1 | 2/2014 | Hull et al. | |
| 2014/0311235 | A1* | 10/2014 | Kirikera | E21B 47/06 73/152.52 |
| 2016/0162614 | A1* | 6/2016 | Pelivanov | G06F 17/5009 703/2 |

OTHER PUBLICATIONS

Barriol, et al., "The Pressures of Drilling and Production," *Oilfield Review*, Autumn Issue 2005, pp. 22-41.

International Search Report and The Written Opinion of the International Search Authority, or the Declaration, dated Sep. 24, 2015, PCT/US2014/073072, 15 pages, ISA/KR.

Julian, et al., "Downhole Leak Determination Using Fiber-Optic Distributed-Temperature Surveys at Prudhoe Bay, Alaska," *SPE Annual Technical Conference and Exhibition*, Nov. 11-14, 2007.

Moussa, "Acoustic-Induced-Vibration Case Study for WDDM Onshore Facilities," *Oil and Gas Facilities*, Jun. 2013, pp. 47-51.

Nikles, et al., "Leakage Detection Using Fiber Optics Distributed Temperature Monitoring," *Proceedings of SPIE—The International Society for Optical Engineering*, vol. 5384, Jul. 18-25, 2004, pp. 18-25.

* cited by examiner

INTEGRATED MULTIPLE PARAMETER SENSING SYSTEM AND METHOD FOR LEAK DETECTION

PRIORITY

The present application is a U.S. National Stage patent application of International Patent Application No. PCT/US2014/073072, filed on Dec. 31, 2014, the benefit of which is claimed and the disclosure of which is incorporated herein by reference in its entirety.

TECHNICAL FIELD

The present disclosure relates generally to oilfield measurement equipment, and in particular to downhole tools, drilling systems, and drilling techniques for drilling wellbores in the earth. More particularly still, the present disclosure relates to logging systems and methods for measuring one or more characteristics within a wellbore indicative of a fluid leak event.

BACKGROUND

Downhole formation fluid (oil and gas) leakage may occur through production tubing, casing, or annular cement sheath in between the casing and formation. Such a fluid leakage may become problematic when either water transports to a production zone or a rich quality production zone communicates with a poor quality production zone through the flow channel created by the leak. If fluid constrained within an annulus becomes pressurized, such as from a leak or thermal expansion, a pressure differential may overstress and/or rupture a casing or tubing wall. The phenomenon of trapped annulus pressure or annular pressure buildup is traditionally addressed by overdesigning casing strings and production tubing, with a concomitant cost penalty. Further, if the leak allows fluid flow between different zones, it may cause a temperature deviation from expected values in addition to the cross-contamination mentioned above. A formation fluid leak may induce dynamic pressure variation throughout the formation, casing, cementing annulus, and production tube.

Identification and accurate location of a downhole fluid leak event is challenging. Typically, identifying a leak event relies on measuring only a single downhole parameter, such as temperature, or pressure, or ultrasonic noise, using a geophone or hydrophone, for example. However, there may be no temperature variation if the fluid leak is from the same production zone, and non-directional dynamic pressure variation may not be suitable for identifying a leak event location. Moreover, singular ultrasonic noise analysis may fail to detect multiple leak locations, particularly if the multiple ultrasonic noise sources have similar broadband frequency spectral signatures. Tubing and casing also provide good acoustic waveguides, hampering acoustic-based leak location efforts.

BRIEF DESCRIPTION OF THE DRAWINGS

Embodiments are described in detail hereinafter with reference to the accompanying figures, in which.

DETAILED DESCRIPTION

Figure 1:
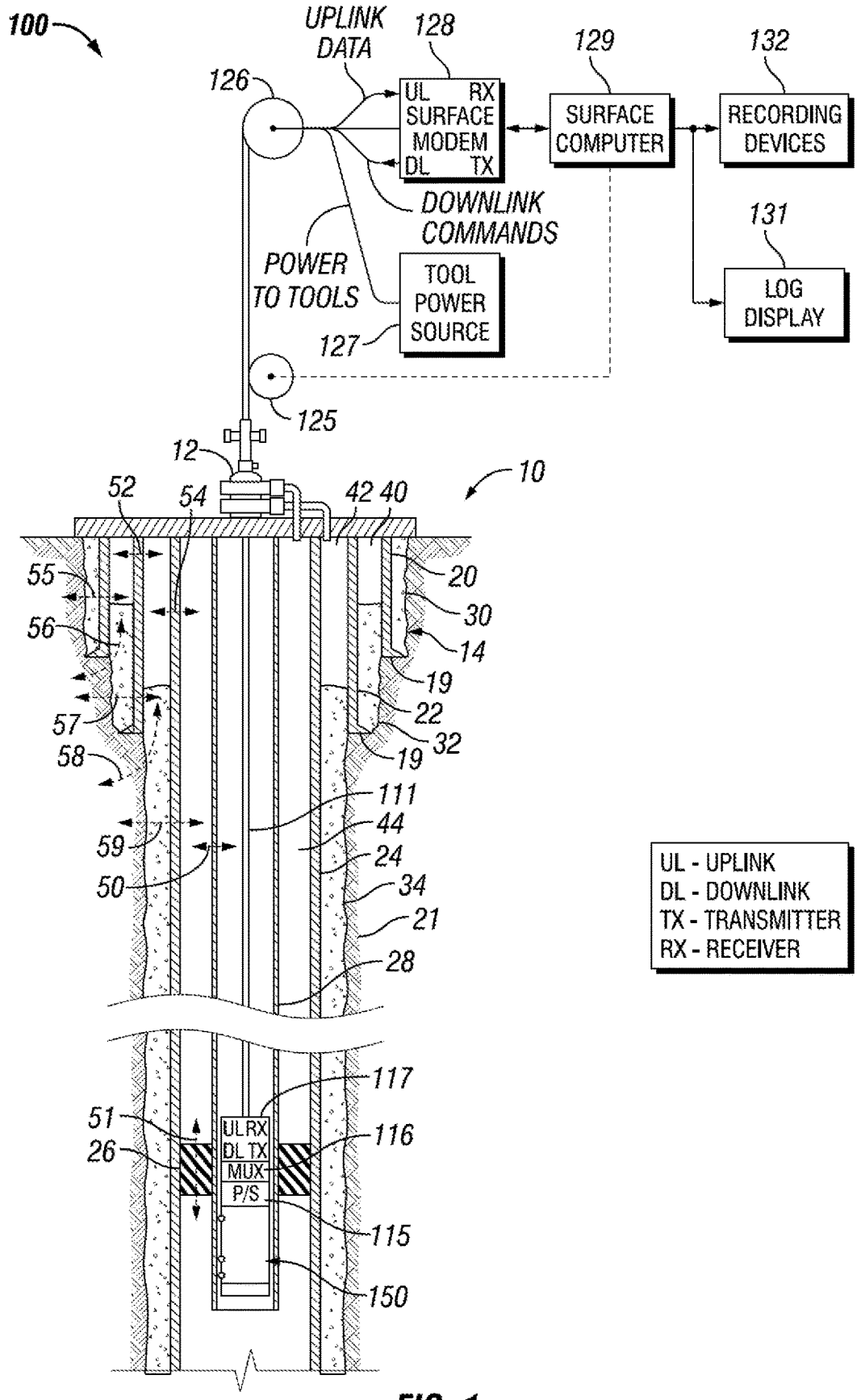
FIG. 1 is a block-level schematic diagram of a leak detection system according to an embodiment, showing a multiple parameter sensing logging tool suspended by wireline in a well.

The present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures.

FIG. 1 shows a system view of a fluid leak detection system 100 according to an embodiment, for identification and evaluation of leakage within a well 10. Well 10 may include a well head 12 connected atop surface casing string 20 extending into the earth from the top of a wellbore 14. Well 10 may include additional, successively smaller diameter outer and inner casing strings 22, 24 concentrically installed in wellbore 14, each smaller string extending to a deeper depth than the previous string. Outer and inner casing strings 22, 24 may be suspended from casing hangers (not illustrated) landed, seated, and locked within well head 12 or otherwise positioned in wellbore 14. Similarly, production tubing 28 may be concentrically installed within inner casing 24, suspended from a tubing hanger (not illustrated) landed and seated within well head 12 or otherwise positioned in wellbore 14. Production tubing 28 may provide a conduit for producing hydrocarbons from formation 21.

Casing strings 20, 22, 24 may isolate wellbore 14 from the surrounding formation 21. The area between any two adjacent casing strings may define a casing annulus. For instance, as shown in FIG. 1, an inner annulus 44 (or "A annulus") may be defined between inner casing string 24 and production tubing 28, an outer annulus 42 (or "B annulus") may be defined between outer casing string 22 and inner casing string 24, and a surface casing annulus 40 (or "C annulus") may be defined between surface casing string 20 and outer casing string 22. Although three casing strings are illustrated in FIG. 1, another number of casing strings may be used as appropriate.

Surface casing string 20 may be cemented into place within wellbore 14 by an outer cement sheath 30. Similarly, outer and inner casing strings 22, 24 may be and cemented into place within wellbore 14 by cement sheaths 32, 34, respectively. Cement sheaths may extend so as to seal the lower end of each annulus, such as adjacent to a casing shoe 19. A packer 26 may be disposed between production tubing 28 and inner casing string 24 to seal lower end of inner annulus 44, or a packer may be positioned between adjacent casing strings, such as 20, 22, to seal the annulus therebetween above the cemented shoe. Additionally, each casing hanger may be sealed within well head 12 by a mechanical seal assembly (not illustrated) so that the upper end of each casing string is sealed from adjacent casings. Accordingly, any fluid located within a casing annulus may be isolated.

According to an embodiment, leak detection system 100 may include a multiple parameter sensing logging tool 150. A logging cable 111 may suspend logging tool 150 in wellbore 14. Logging tool 150 may have one or more protective housings which may be fluid tight, be pressure resistant, and support and protect internal components during deployment. Logging tool 150 may include one or more subsystems to generate data useful in analysis of wellbore 14 or in determining the nature of formation 21 in which wellbore 14 is located.

Logging tool 150 may include a power supply 115. Output data streams from logging tool 150 may be provided to a multiplexer 116. Logging tool 150 may also include a communication module 117 having an uplink communication device, a downlink communication device, a data transmitter, and a data receiver.

Logging tool 150 may be designed and arranged so as to be combinable with other tools with suitable mechanical and electrical designs. Logging tool 150 may, for example, be added to other tool sections designed for leak detection, including an accelerometer, acoustic/seismic sensing array, or a pressure/temperature variation based flow detection tool.

Leak detection system 100 may include a sheave 125, which may be used in guiding logging cable 111 into wellbore 14. Cable 111 may be spooled on a cable reel 126 or drum for storage. Cable 111 may be let out or taken in to raise and lower logging tool 150 within wellbore 14. Conductors in cable 111 may connect with surface-located equipment, which may include a DC power source 127 to provide power to tool power supply 115, a surface communication module 128 having an uplink communication device, a downlink communication device, a data transmitter and receiver, a surface computer 129, a logging display 131, and one or more recording devices 132. Sheave 125 may be connected by a suitable detector arrangement to an input to computer 129 to provide logging tool depth measuring information. Computer 129 may provide an output for logging display 131 and recording device 132. Leak detection system 100 may collect data as a function of depth. Recording device 132 may be incorporated to make a record of the collected data as a function of wellbore depth. Computer 129 is illustrated as located at the surface of the well for real-time processing uplinked data and/or post processing data locally stored within memory located within logging tool 150.

Many possible fluid leakage paths may be present in well 10 as illustrated by arrows 50-52, 54, and 55-59. A fluid leakage may occur through a breach in production tube 28, thereby fluidly coupling the interior of production tube with inner annulus 44, as indicated by arrow 50. A leak across packer 26, illustrated by arrow 51, may also fluidly couple the interior of production tube with inner annulus 44. A breach in outer casing string 22, depicted by arrow 52, may fluidly couple surface casing annulus 40 with outer annulus 42. Similarly, a breach in inner casing string 24, depicted by arrow 54, may fluidly couple outer annulus 42 with inner annulus 44. Finally, fluid leakage may occur between formation 21 and various annuli. For instance, surface casing annulus 40 may be fluidly coupled with formation 21 via a breach in surface casing string 20 and cement sheath 30 or via a breach in cement sheath 32, as indicated by arrows 55, 56, respectively. Likewise, outer annulus 42 may be fluidly coupled with formation 21 via a breach in outer casing string 22 and cement sheath 32 or via a breach in cement sheath 34, as indicated by arrows 57, 58, respectively. And, inner annulus 44 may be fluidly coupled with formation 21 via a breach in inner casing string 24 and cement sheath 34, as indicated by arrow 59.

Following the development of a wellbore leak at a specific geological depth, there may occur a potential thermal profile variation near the leak point due to John-Thomson effect or Joule Kelvin effect if the fluid is in a gaseous phase. The fluid flow pattern may reach a new steady state balance, with a pressure gradient near the leak point. Depending on the nature of the leak, a local reduction or increase in pressure near the leak point may occur. Dynamic temperature and acoustic pressure changes may also be accompanied by a localized change in flow velocity and noise due to leak termed as "leak noise." Leakage fluid flow noise may be in the 1-10 kHz frequency range. The changes in temperature, pressure, and leak noise profile may depend on size of the leak (flow rate), the phase composition of the leak flow, and the downhole geological location of the leak.

Figure 2:
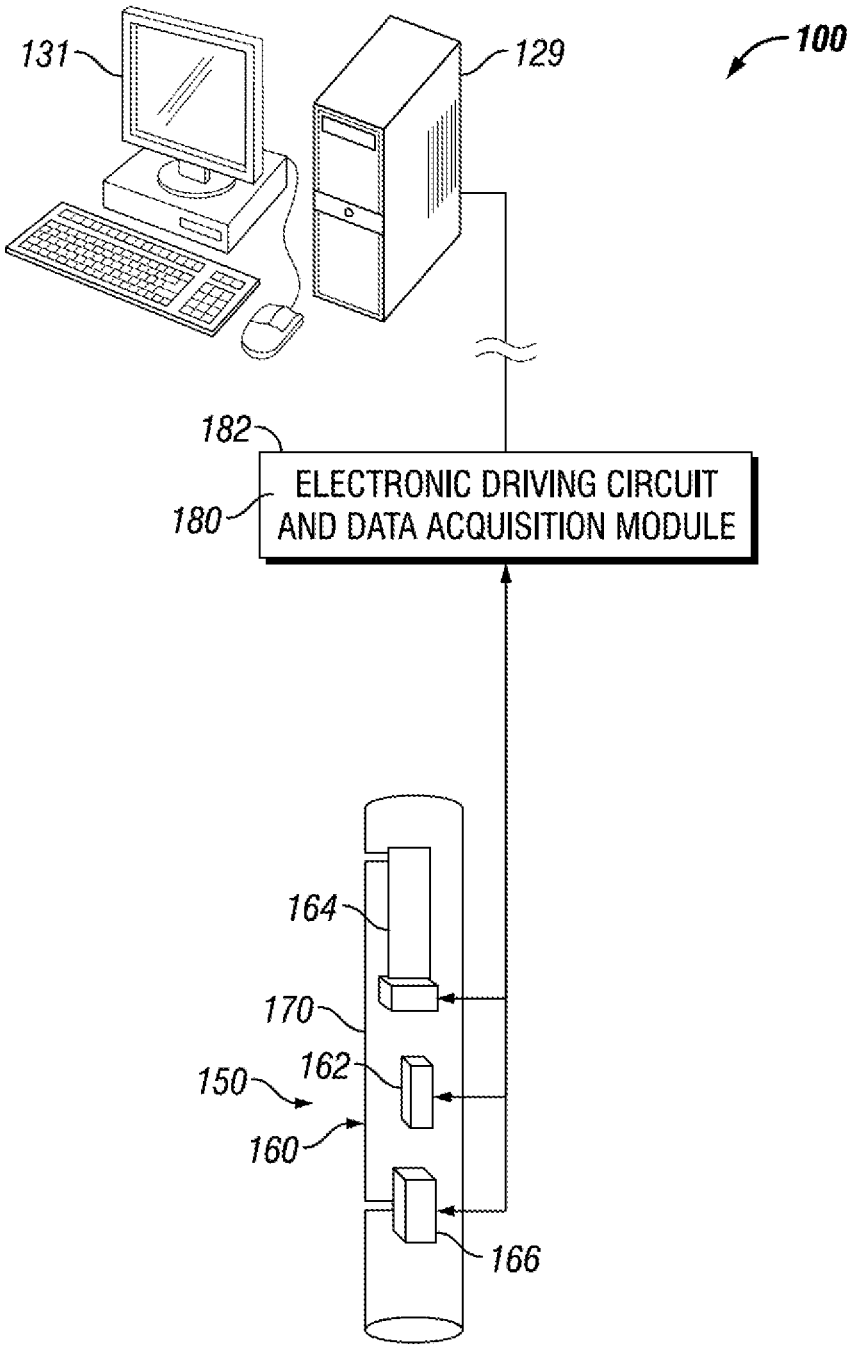
FIG. 2 is a block-level schematic diagram of a multiple parameter sensing leak detection system according to an embodiment, showing a temperature detector, a pressure detector, and an acoustic detector collocated within a sensing module.

FIG. 2 is a block-level schematic diagram of a multiple parameter (multi-parameter) sensing leak detection system 100 according to one or more embodiments. Multi-parameter sensing logging tool 150 may include one or more multi-parameter sensing modules 160 that may be capable of simultaneously measuring downhole temperature, pressure, and acoustic signals.

Accordingly, multi-parameter sensing module 160 may be arranged for simultaneous detection of pressure, temperature and flow noise via a temperature detector 162, an acoustic pressure detector 164, and an acoustic detector 166. In an embodiment, temperature detector 162 and acoustic pressure detector 164 may each include a quartz crystal, and acoustic detector 166 may include a piezoelectric crystal. The resonant frequencies of these crystals may be tuned for temperature detector 162 to be sensitive to temperature change only, for pressure detector 164 to be sensitive to both temperature and pressure, and for acoustic detector 166 to be sensitive to leak vibration noise along with temperature, and pressure. Thus, the relative change of resonant frequency between temperature detector 162 quartz crystal and acoustic pressure detector 164 quartz crystal may be used to determine pressure.

Likewise, the relative change of resonant frequency between acoustic pressure detector 164 quartz crystal and acoustic detector 166 piezoelectric crystal may be used to measure leak-induced ultrasonic noise.

Detectors 162, 164, 166 may be sealed in a cylindrical package 170. An electronic driving circuit 180 may be provided to drive resonators of detectors 162, 164, and 166 to at an appropriate frequency, and a data acquisition module 182 may be provided to receive, format, transmit, and or process outputs from detectors 162, 164, and 166. Driving circuit 180 and data acquisition module 182 may be located within package 170, or they may be provided elsewhere.

Figure 3:
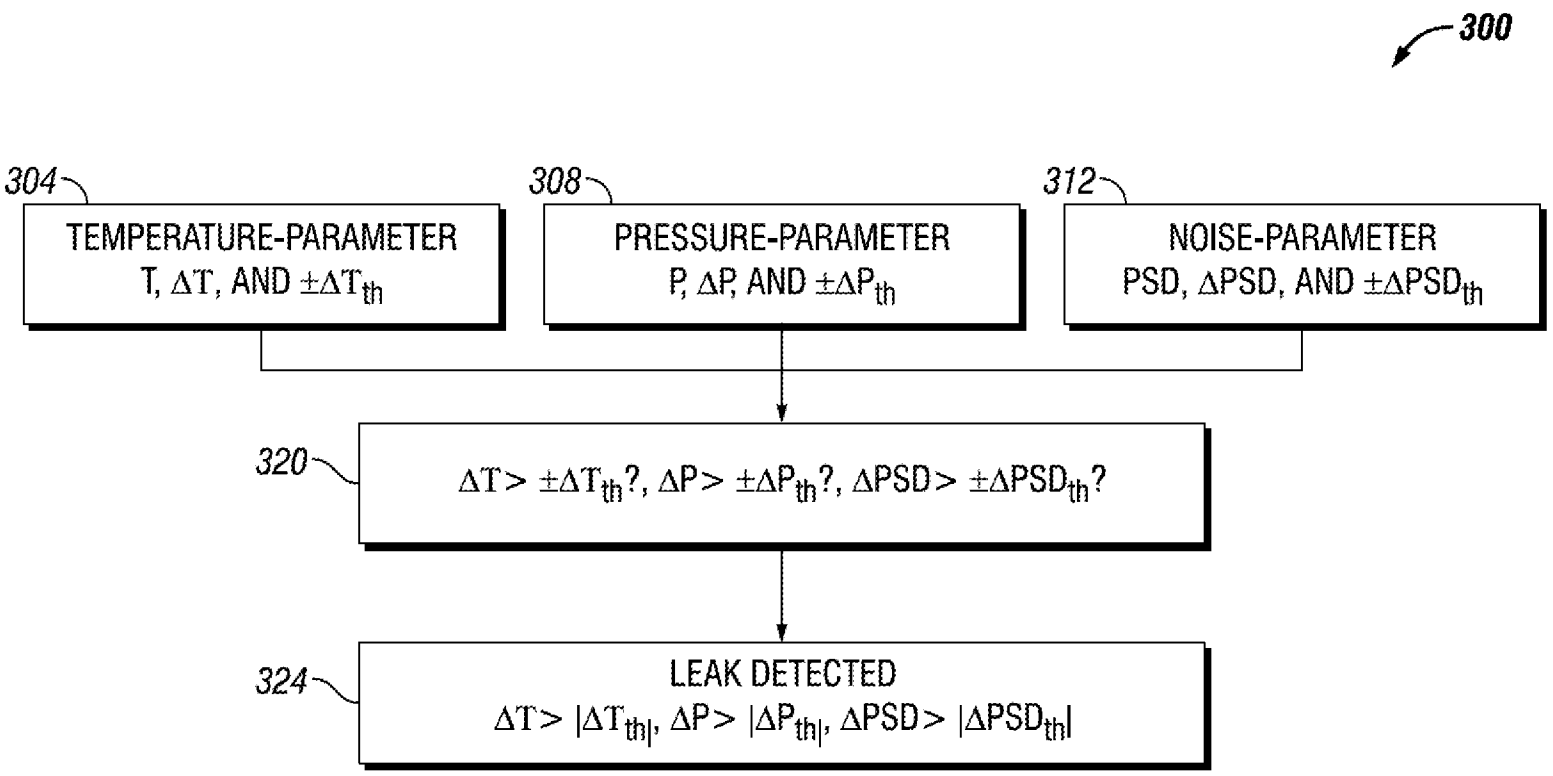
FIG. 3 is a flowchart of a method for determining the presence of a leak using the leak detection system of FIG. 2, for example.

Referring now to FIG. 3, a method 300 for multi-parameter leak detection according to one or more embodiments is illustrated in the form of a flow chart. In one or more embodiments of multi-parameter leak detection method 300, and as shown in step 304, a leak may be determined by singularly sensing a downhole temperature parameter. A formation fluid leak may create a mass-transfer process within wellbore 14, which may produce changes in the wellbore temperature, which may be given by $$T=T_o(z)+T(z,t) \quad \text{Eq. 1}$$

where $T_o(z)$ is local static temperature, T(z,t) represents dynamic or transient temperature variation due to flowing fluid or exchange of different thermal capacities. Measuring wellbore temperature may be useful in identifying fluid ingress and egress within wellbore 14, in determining the effects of temperature change on compression or decompression (Joule-Thompson effects), in detecting the movement of gas phase fluids behind the casing, and in identifying type of fluid entries into the wellbore. In general, the dynamic temperature change may be dependent fluid flow rate and the flowing direction.

When ingressive fluid is characterized by a different thermal capacity than the original wellbore fluid, the downhole temperature may change, specifically for vertically upward or downward fluid flow cases. Whenever the temperature variation becomes larger than a predetermined threshold $\pm\Delta T_{th}$, a leak event may be identified. That is, a leak event may be indicated by $\Delta T>\pm|\Delta T_{th}|$. However, as the dynamic temperature may not significantly change for a horizontal fluid flow leak event, pressure and acoustic sensors, as described hereinafter, may be used to analyze such leak events.

Figure 4A:
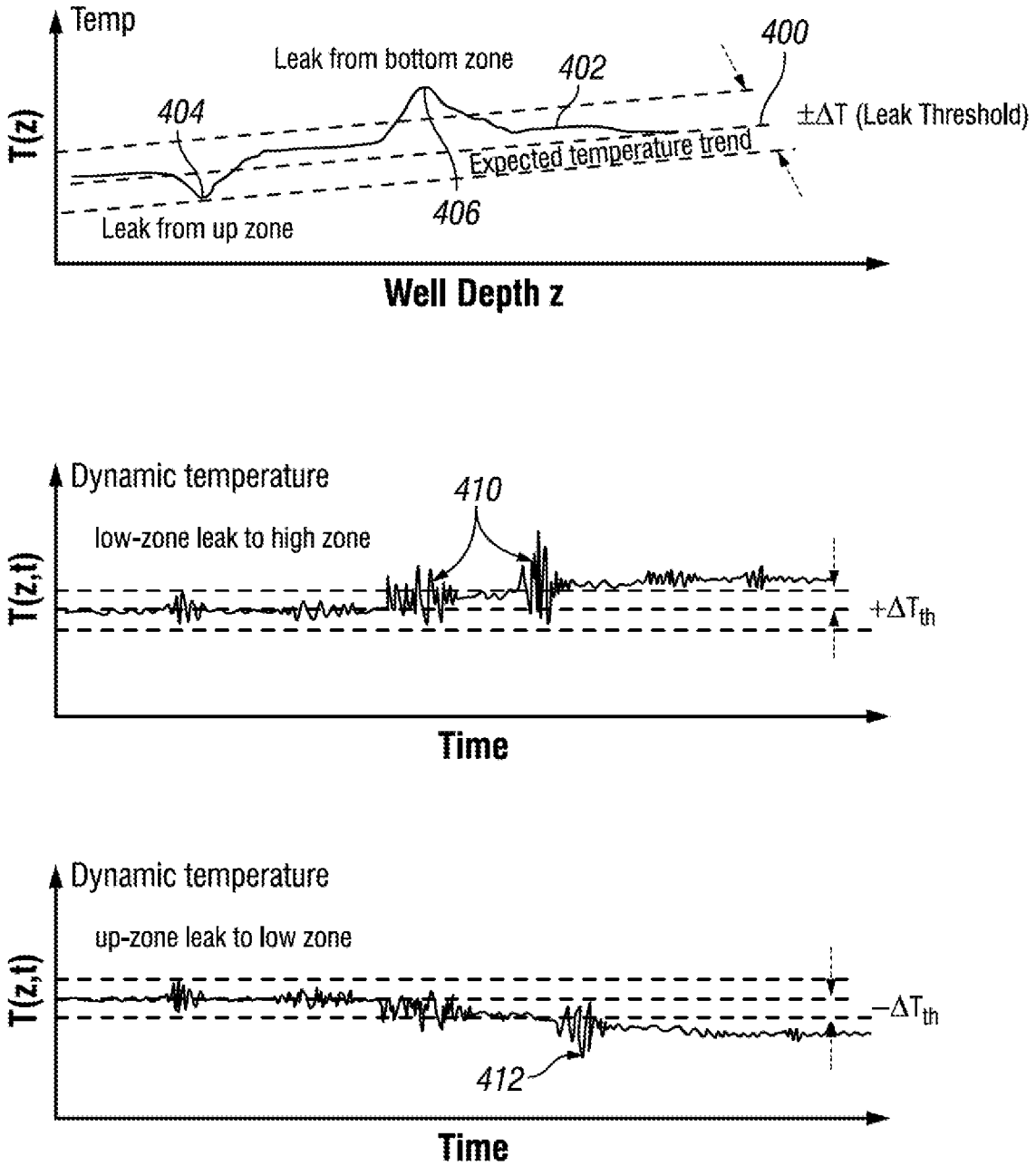
FIGS. 4A-4C are exemplary simulated plots of temperature, pressure, and power spectral density, respectively, illustrating the leak detection method of FIG. 3.

FIG. 4A illustrates an exemplar temperature versus depth profile for illustration of leak detection using step 304 of FIG. 3. The upper plot illustrates an expected temperature trend by dash line 400 and an actual wellbore temperature 402. A leak from an upper zone is indicated at 404, which lowers the local wellbore temperature in its vicinity. A leak from a bottom zone is indicated at 406, which raises the local wellbore temperature in its vicinity. The middle plot shows the dynamic temperature at depth plotted over time. As indicated by arrow 410, the measured temperature change $\Delta T$ exceeds threshold temperature $|\Delta T_{th}|$ due to the bottom zone leak 402. Similarly, the lower plot shows the dynamic temperature at depth plotted over time. As indicated by arrow 412, the measured temperature change $\Delta T$ exceeds threshold temperature $|\Delta T_{th}|$ due to the upper zone leak 404.

Figure 4B:
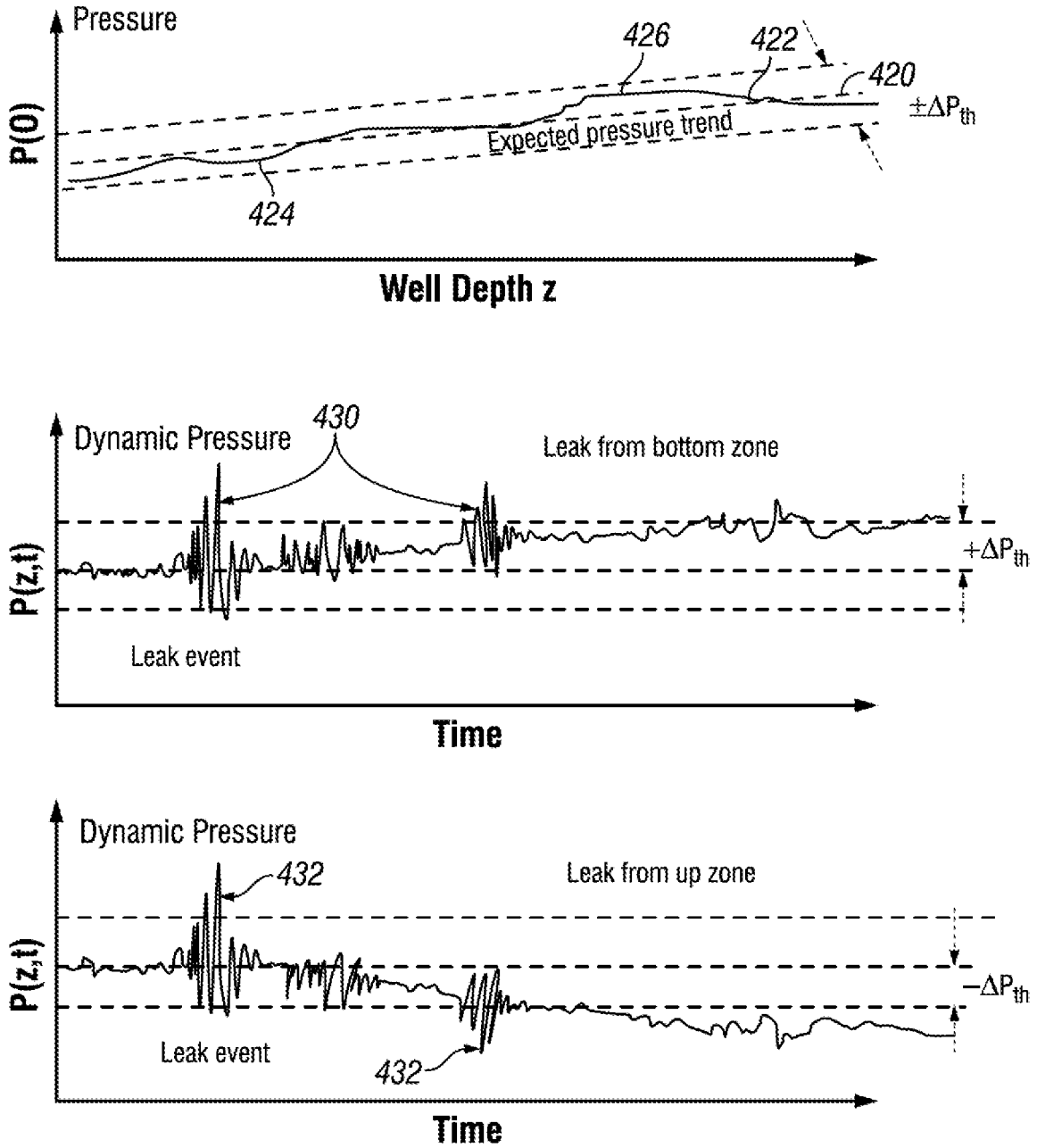

Referring to FIGS. 3 and 4B, in one or more embodiments and as shown in step 308, a leak may be determined by singularly sensing a downhole pressure parameter, which may be given by $$P=p_o(z)+p(z,t) \quad \text{Eq. 2}$$

where P is total pressure, $p_o(z)$ is static pressure (10-30 kpsi) at well depth of z, and p(z,t) represents the fluid leak induced acoustic pressure at well depth z. A well leak may emit broadband acoustic noises ranging from a frequency of f(1) to f(N), where the associated acoustic pressure wave may be described by $$p(z,t)=\Sigma_{i=1}^{N}P(i)e^{-i(2\pi f(i)t+kz)} \quad \text{Eq. 3}$$

where P(i) represents the pressure amplitude of a specific harmonic wave.

A leak event may also induce a significant acoustic pressure variation due to fluid transport from different zones or reservoir locations by local acoustic impedance change:

$$p(z,t)=\Delta Z\approx\Delta\rho v^2 \quad \text{Eq. 4}$$

where $\Delta Z$ Apv reflects local acoustic density variation, and v is local fluid speed of sound.

When an ingressive fluid has different fluid density than the original wellbore fluid, the downhole pressure may change due to such fluid density variation. Whenever the pressure variation is larger than a threshold $\pm\Delta P_{th}$, a leak event may be identified. That is, a leak event may be indicated by $\Delta P>\pm|\Delta P_{th}|$. Additionally, pressure may provide important information about the phase behavior of the formation fluids. When pressure varies at the boiling point, the formation phase may change from a single phase to a two-phase mixture, or possibly a three-phase mixture, which enables clear leak identification by both temperature and pressure sensors.

FIG. 4B illustrates an exemplar acoustic pressure versus depth profile for illustration of leak detection using step 308 of FIG. 3. The upper plot illustrates an expected pressure trend by dash line 420 and an actual wellbore pressure 422. A leak from an upper zone is indicated at 424, which raises the local wellbore pressure in its vicinity. A leak from a bottom zone is indicated at 426, which lowered the local wellbore pressure in its vicinity. The middle plot shows the dynamic pressure at depth plotted over time. As indicated by arrow 430, the measured pressure change $\Delta P$ exceeds threshold pressure $|\Delta P_{th}|$ due to the bottom zone leak 402. Similarly, the lower plot shows the dynamic or acoustic pressure at depth plotted over time. As indicated by arrow 432, the measured pressure change $\Delta P$ exceeds threshold pressure $|\Delta P_{th}|$ due to the upper zone leak 424.

Figure 4C:
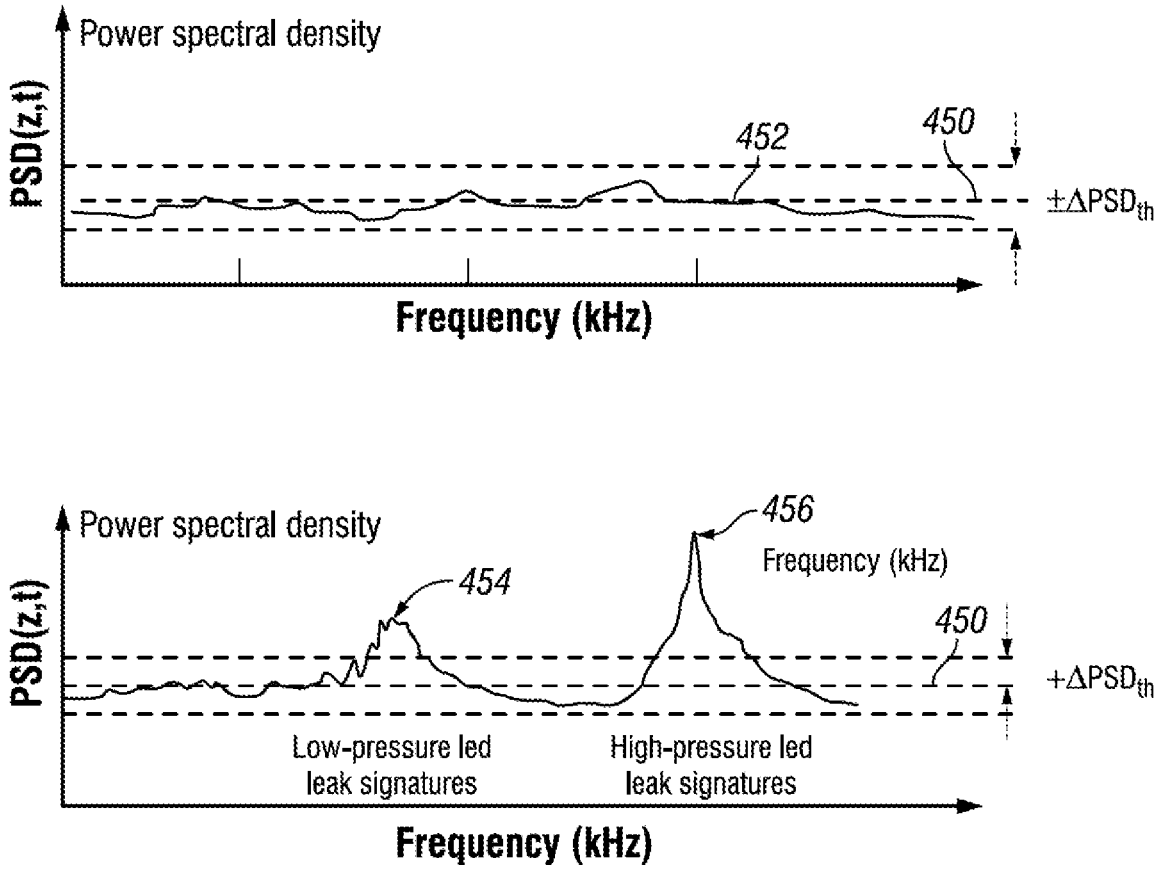

Similarly, referring to FIGS. 3 and 4C, in one or more embodiments and as shown in step 312, a leak may be determined by singularly sensing an acoustic noise parameter, which may be a seismic noise (10-100 Hz), acoustic noise (100 Hz-20 kHz), or ultrasonic noise (>20 kHz). Downhole hydraulic pressure varies with depth, flow-rate, type of formation fluids, and geologic structures. Dynamic pressure changes may be accompanied by a transient change in flow velocity, which in turn may lead to leak noise. Some changes in leak size, flow volume, and/or flow rate may induce ultrasonic noise with specific frequency signatures, as indicated by Equations 3 and 4 supra. For example, at a constant flow rate, a gas phase leak may create more acoustic or ultrasonic noises than an aqueous fluid flow. A small leak under high differential pressure may produce high frequency noises. Similarly, flow noise may become undetectable if the different pressure across the leak path is too low. Acoustic or ultrasonic noise frequency signatures may also change due to phase change in multi-phase leak events or when the ingressive fluid has a different phase than the original wellbore fluid. Whenever the power spectral density (PSD) variation of the leak induced noise is larger than a threshold $\pm\Delta PSD_{th}$, a leak event may be identified. That is, a leak event may be indicated by $\Delta PSD>\pm|\Delta PSD_{th}|$.

FIG. 4C illustrates an exemplar power spectral density (PSD) versus depth profile for illustration of leak detection using step 312 of FIG. 3. Power spectral density may be obtained by converting signals from acoustic detector 166 to the frequency domain, such as by using a fast Fourier transform. The upper plot illustrates an expected power spectral density at depth versus frequency trend by dash line 450 and an actual wellbore power spectral density 452 for a well with no leaks. The lower plot shows a power spectral density at depth versus for a well with both a low pressure leak and a high pressure leak. As indicated by arrows 454 and 4456, the measured power spectral density change ΔPSD exceeds threshold power spectral density $|\Delta PSD_{th}|$ for both leaks, with the higher pressure leak having a larger signature.

At step 320, temperature, pressure and power spectral density parameters may be measured by multi-parameter sensing module 160 (FIG. 2). Temperature, pressure and power spectral density parameters may be measured serially or simultaneously. The measured parameters may be processed in real time or at a later time by computer 129. Although a single parameter may be indicative of a leak, multiple corroborating parameters may provide both greater certainty and better location and severity information regarding such leak, as indicated by step 324.

As outlined above, by measuring static and dynamic pressure and temperature and their amplitude variations, as well as performing broadband noise frequency signature analysis, a major or minor leak event may be identified by setting relative variation thresholds from normal temperature, pressure, and noise power spectral density values. Suitable thresholds may be used to identify a potential leakage situation. Any temperature, pressure, and acoustic variation within upper and lower limits surrounding averaged local temperature and pressure may be indicative of a normal well condition. On the other hand, when one or more of the three sensing parameters fall outside of the expected thresholds, a potential leakage may be indicated. Accordingly, multi-parameter analysis may be used for a comprehensive evaluation for potential formation fluid leak events. Moreover, an annular or inter-annular leakage-induced noise spectrum signature may be associated with leakage size, and noise amplitude may be associated with leakage location. Differential pressure and temperature may be used to further identify leakage location. Accordingly, multi-parameter sensing leak detection system 100 may be used to identify leakage location, quantity, whether the leakage is annular or inter-annular in nature.

Figure 5:
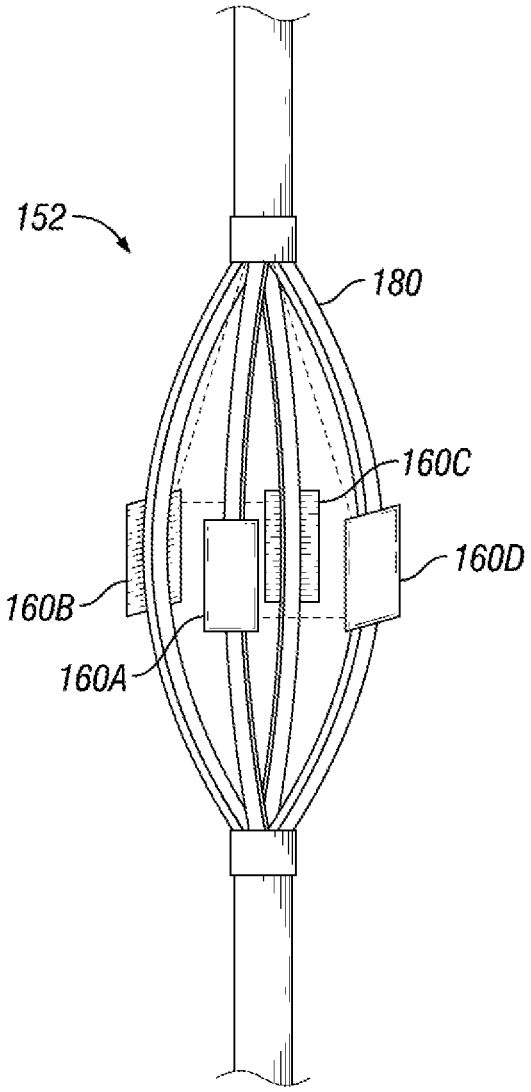
FIG. 5 is a simplified perspective view of a multiple parameter sensing leak detection system according to an embodiment, showing a circumferential arrangement of sensing modules, which may be sensing modules as illustrated in FIG. 2, carried by a mechanical caliper assembly.

FIG. 5 is a simplified perspective view of a multiple parameter sensing leak detection system 152 according to an embodiment. A circumferential arrangement of spaced apart or dispersed sensing modules 160 may be carried by a mechanical caliper assembly 180 or similar arrangement. In an embodiment, caliper assembly 180 may be a four arm caliper system that may be suitable for open-hole, cased-hole, and completed wellbore leak detection logging. Four sensing modules 160A-D are illustrated in system 152 of FIG. 5, but another suitable number of sensing modules 160 may be provided. In one or more embodiments, each sensing module 160 may be individually used with a dedicated electric driving circuit 180 and data acquisition module 182. In one or more embodiments, each of the multiple sensing modules 160 may share a single electric driving circuit 180 and data acquisition module 180. Other combinations may be used. Moreover, while sensing modules are illustrated as circumferentially disposed, they may alternatively or additionally be longitudinally dispersed or separated.

A baseline pressure and temperature profile may be generated using leak detection system 152 as follows. In absence of any leak, the temperature and pressure profiles may approximate a linear function of depth z: $P(z) \approx P(0)+az$, and $T(z) \approx T(0)+bz$, with slopes a and b respectively. Any change in production flow may cause a relevant change in temperature and pressure. Leak induced temperature and pressure changes may be identified by comparing such measurements to the baseline temperature and pressure profiles.

Figure 6:
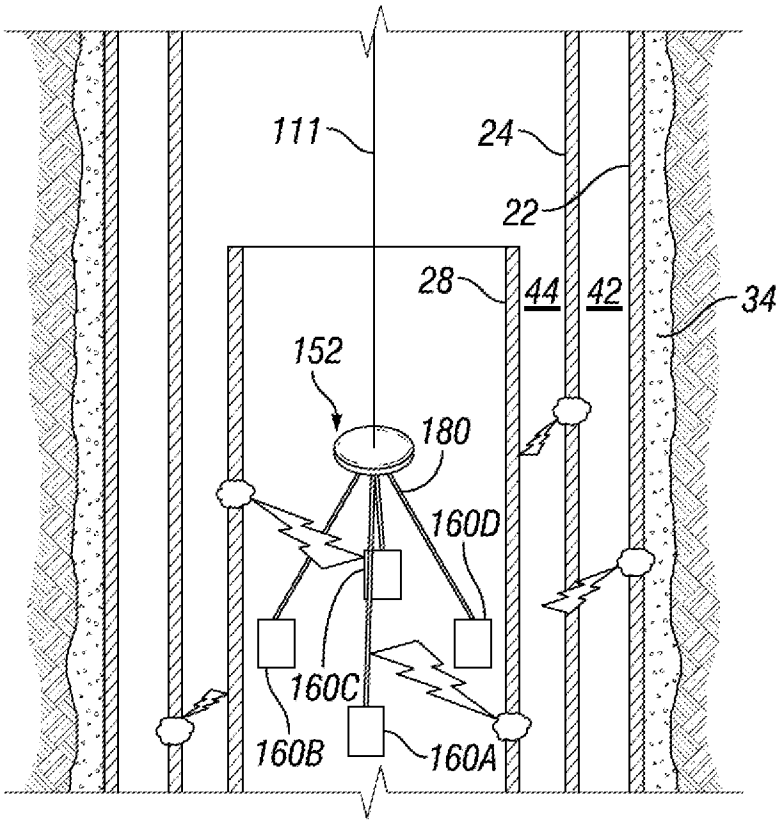
FIG. 6 is a simplified perspective view of a multiple parameter sensing leak detection system of FIG. 5 operating within a wellbore.

By using triangulation, beamforming, or other position locating techniques using dispersed points of measurement, multi-parameter sensing leak detection system 152, with its circumferential arrangement of sensing modules 160, may facilitate identification radial direction of a leak location. As indicated in FIG. 6, a leak may come from production tubing 28 or casing or cementing annulus locations 42, 44. Four individual sensing modules 160 may measure the same temperature and pressure but with different noise intensity and frequency signatures from the surrounding medium. In one case, the noise intensity may be used for location identification by beamforming, triangulation, or other techniques using multiple dispersed points of measurement. The noise intensity or power may be strong from production tubing 28 but gradually damped by casing 22, 24 and cement sheath 34. The measured acoustic pressure from a specific pressure wave $$P(i)=e^{-az}|p(i)| \quad \text{Eq. 5}$$

is normally attenuated from a central leak point, where a is an attenuation coefficient (1/m). Accordingly, attenuation coefficient α may depend on the leak noise frequency. Such a well depth dependent pressure signature may assist the identification of a fluid leak point at well depth z.

Operation of leak detection system 152 may use average measurements to establish a baseline, but any anomalous spikes or frequency signatures may be used for leak identification. Multiple sensing modules 160 may minimize failure to identify small leakage points.

Figure 7:
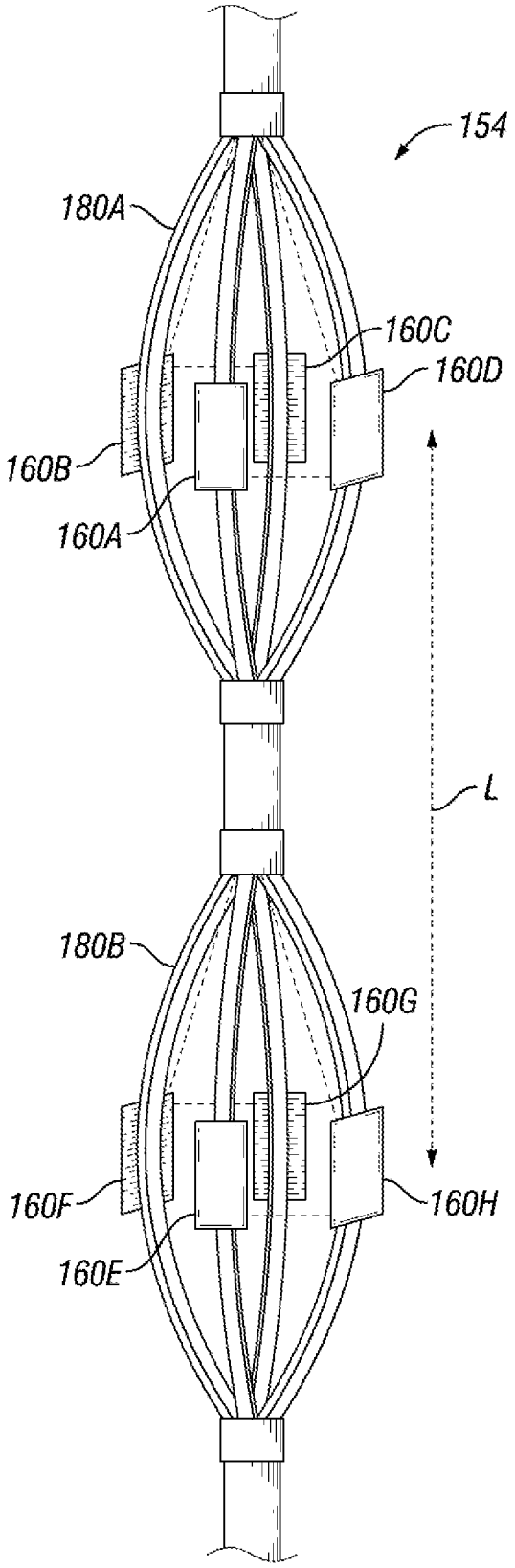
FIG. 7 is a simplified perspective view of a multiple parameter sensing leak detection system according to an embodiment, showing upper and lower circumferential arrangements of sensing modules.

FIG. 7 is a simplified perspective view of a multiple parameter sensing leak detection system 154 according to one or more embodiments. Dual circumferential arrangements of sensing modules 160 may be carried by upper and lower mechanical caliper assemblies 180A, 180B or similar arrangement. In an embodiment, each caliper assembly 180 may be a four arm caliper system that may be suitable for open-hole, cased-hole, and completed wellbore leak detection logging. In system 154 of FIG. 7, four sensing modules 160A-D are illustrated as carried by upper caliper 180A, and four sensing modules 160F-H are illustrated as carried by lower caliper 180B. Upper sensing modules 160 may be separated from lower sensing modules by a distance L. However, other suitable numbers and arrangements of sensing modules 160 may be provided. The number of sensing modules 160 and the angular separation between sensing modules 160 may be varied to provide desired resolution in the radial and azimuthal directions at a given depth. The distance L between upper and lower calibers 180A, 180B may be set to obtain desired resolution in locating a leak along the depth z of the well as well the radial distance of the leak with respect to the axis of the wellbore.

In one or more embodiments, each sensing module 160 may be individually used with a dedicated electric driving circuit 180 and data acquisition module 182. In one or more embodiments, each of the multiple sensing modules 160 may share a single electric driving circuit 180 and data acquisition module 180. Other combinations may also be used.

Figure 8:
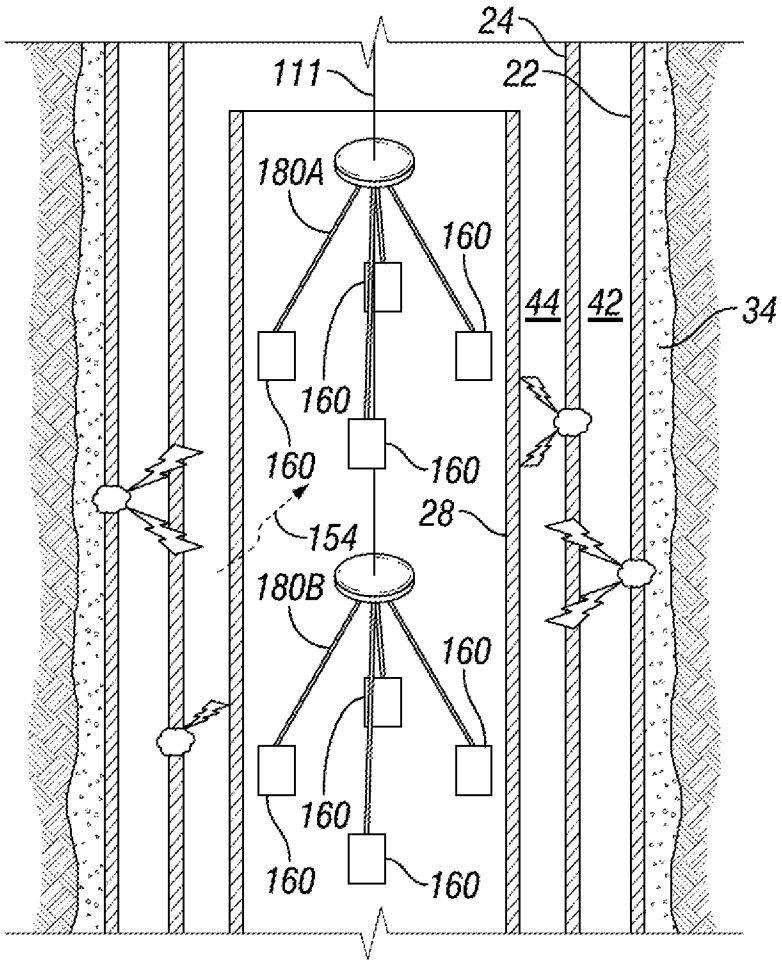
FIG. 8 is a simplified perspective view of a multiple parameter sensing leak detection system of FIG. 6 operating within a wellbore.

Referring to FIG. 8, leak detection system 154, with dual two calipers 180 each carrying multiple sensing modules 160, may identify the location of annular leakage by differentiating pressure and temperature distributions. To clearly identify an exact leak location if it is behind production tubing 28 or casing 24, 22, the plurality of sensing modules 160 may be analyzed as a cascaded array. For a leak event, the temperature and pressure measurements may be able to detect weak variations, but they may fail to detect significant relative variation amplitudes that are clearly outside of the thresholds ($\pm\Delta P_{th}$, $\pm\Delta T_{th}$). However, the noise detection from different sensing modules may show some noteworthy frequency signatures from transient power spectral density. For a minor leak behind production tubing 28 and casing 24, the damped noise signals may increase the background of the power spectral density or detect notable frequency features. For a major leak event, the potential frequency signature may be significantly distributed in frequency domain with a strong increase above the threshold $\Delta PSD_{th}$. The amplitudes of power spectral density from multiple sensing modules 160 may be used to calculate the leak location based on triangulation or beamforming techniques.

Figure 9A:
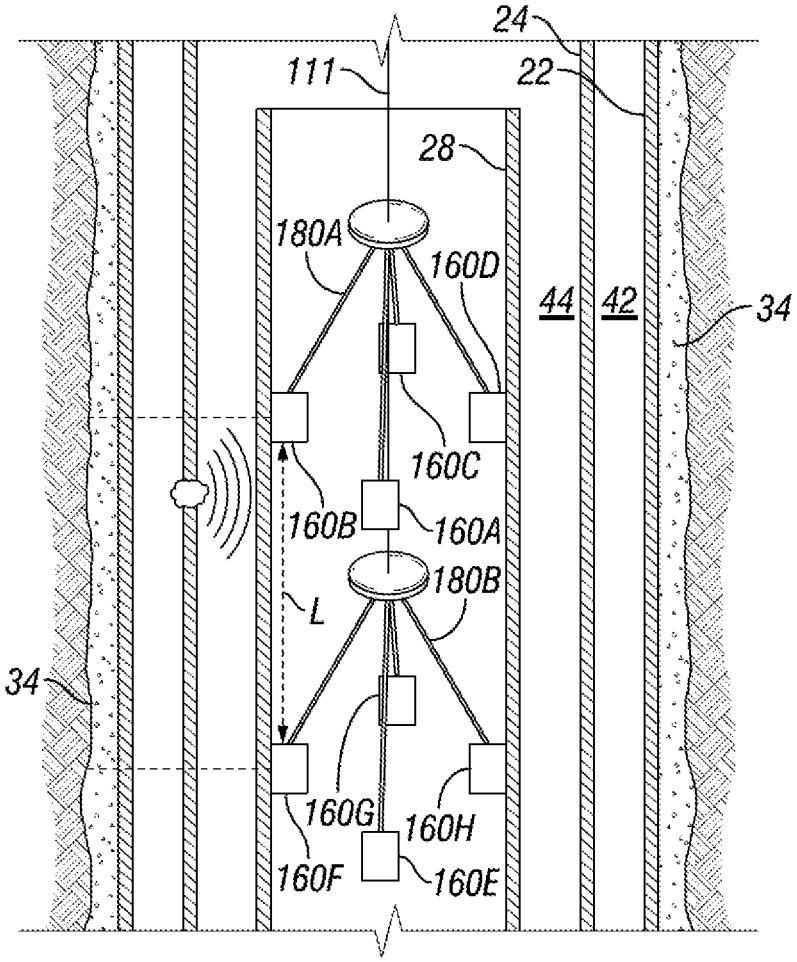
FIG. 9A-9C illustrate the multiple parameter sensing leak detection system of FIG. 6 operating within production tubing within a wellbore, showing a technique for pinpointing a casing leak location beyond the production tubing using multiple power spectral density measurements.
Figure 9B:
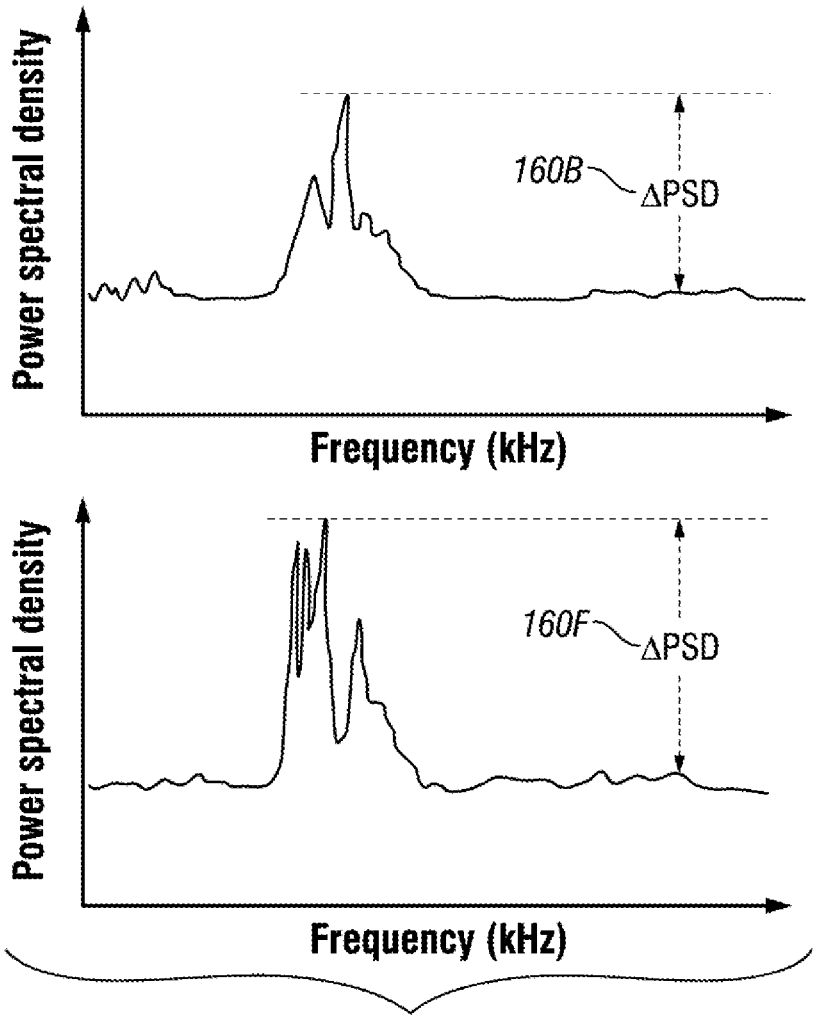
Figure 9C:
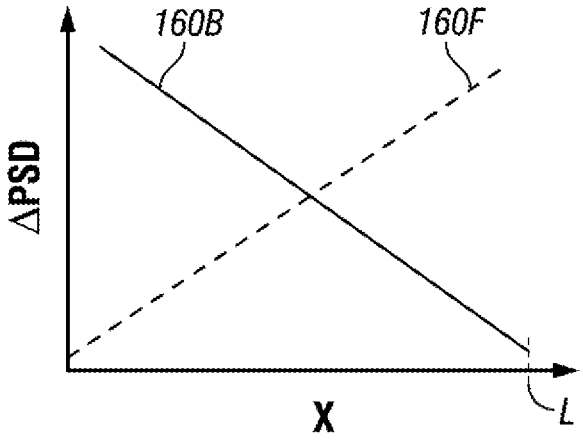

FIGS. 9A-9C illustrates a specific case where both dynamic pressure and temperature may not have any anomalies, but two sensing modules may acquire a notable frequency signature from power spectral density analysis. As illustrated in FIG. 9A, a leak may be through casing 24 behind production tubing 28. The ultrasonic noise sensors of sensing modules 160B and 160F may provide power spectral density plots as shown in FIG. 9B. The ultrasonic noise sensors of sensing modules 160B and 160F are separated by distance L, and because both power spectral density frequency signatures have different magnitudes, the leak location may be identified by the magnitude ratio, $\Delta PSD_{160B}/\Delta PSD_{160F}$, as shown in FIG. 9C. Similarly, ultrasonic noise sensors of sensing modules 160D and 160H may also provide a ratio, which also can be used to corroborate the axial leak location. Radial location may be identified by the same technique using different pair of sensing modules, such as the 160A/160B pair, or the 160B/160C pair.

In summary, a logging tool and a method for detecting a leak source in a wellbore have been described. Embodiments of the logging tool may generally have: A first temperature detector; a first pressure detector disposed in proximity to the first temperature detector; a first acoustic detector disposed in proximity to the first temperature detector; data acquisition circuitry coupled to the first temperature detector, the first pressure detector, and the first acoustic detector; and a processor coupled to the data acquisition circuitry and arranged to correlate a temperature parameter, a pressure parameter, and an acoustic parameter to identify a leak source. Embodiments of the method may generally include: Measuring a first temperature parameter at a first point in the wellbore by a first temperature detector; measuring a first pressure parameter at the first point by a first pressure detector; measuring a first acoustic parameter at the first point by a first acoustic detector; and correlating the first temperature parameter, first pressure parameter, and first acoustic parameter to identify a leak source.

Any of the foregoing embodiments may include any one of the following elements or characteristics, alone or in combination with each other: The first temperature detector, the first pressure detector, and the first acoustic detector are collocated within a first sensing module; at least second and third acoustic detectors equally disposed about a circumference at a same axial position as the first acoustic detector, the data acquisition circuitry coupled to at least the second and the third acoustic detectors; the processor is arranged to calculate an azimuthal angle and a radial distance to the leak source with respect to a position of the logging tool; a second acoustic detector disposed at a different axial position from the first acoustic detector, the data acquisition circuitry coupled to the second acoustic detector; the processor is arranged to calculate an elevation of the leak source with respect to a position of the logging tool; at least second and third acoustic detectors equally disposed about a first circumference at a same axial position as the first acoustic detector; at least fourth, fifth, and sixth acoustic detectors equally disposed about a second circumference at a different axial position from the first acoustic detector; the data acquisition circuitry coupled to at least the second, third, fourth, fifth, and sixth acoustic detectors; the processor is arranged to calculate an azimuthal angle, a radial distance, and an elevation to the leak source with respect to a position of the logging tool; a second temperature detector disposed in proximity to the fourth acoustic detector; a second temperature detector disposed in proximity to the fourth acoustic detector; the first temperature detector is a quartz temperature gauge; the first pressure detector is a quartz temperature compensated pressure gauge; the first acoustic detector is a piezoelectric element; collocating the first temperature detector, the first pressure detector, and the first acoustic detector within a first sensing module; measuring second and third acoustic parameters by second and third acoustic detectors located at a same axial position as the first acoustic detector; calculating an azimuthal angle and a radial distance with respect to a position of the logging tool to the leak source by correlating the first, second, and third acoustic parameters; measuring a second acoustic parameter by a second acoustic detector disposed at a different axial position from the first acoustic detector; calculating an elevation with respect to a position of the logging tool to the leak source by correlating the first and second acoustic parameters; measuring second and third acoustic parameters by second and third acoustic detectors located at a same axial position as the first acoustic detector; measuring fourth, fifth, and sixth acoustic parameters by fourth, fifth, and sixth acoustic detectors disposed at a different axial position from the first acoustic detector; calculating an azimuthal angle, a radial distance, and an elevation with respect to a position of the logging tool to the leak source by correlating the first, second, third, fourth, fifth, and sixth acoustic parameters; measuring a second temperature parameter by a second temperature detector disposed in proximity to the fourth acoustic detector; disposing a second temperature detector in proximity to the fourth acoustic detector; measuring a temperature by a quartz temperature gauge; measuring a pressure by a quartz temperature compensated pressure gauge; measuring an acoustic signal by a piezoelectric element; and converting the acoustic signal to a frequency domain.

The Abstract of the disclosure is solely for providing the reader a way to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A logging tool comprising:

a first temperature detector;

a first pressure detector disposed in proximity to said first temperature detector;

a first acoustic detector disposed in proximity to said first temperature detector;

data acquisition circuitry coupled to said first temperature detector, said first pressure detector, and said first acoustic detector;

at least second and third acoustic detectors disposed about a circumference at a same axial position as said first acoustic detector, said data acquisition circuitry coupled to at least said second and said third acoustic detectors; and a processor coupled to said data acquisition circuitry and arranged to correlate a temperature parameter, a pressure parameter, and an acoustic parameter to identify a leak source, said correlation comprising:

determining expected parameter trends along said wellbore, said parameter trends being a temperature trend, pressure trend, and acoustic trend;

determining threshold variations from said expected parameter trends;

obtaining parameter measurements along said wellbore, said parameter measurements being a temperature, pressure and acoustic measurement;

determining variations in said parameter measurements along said wellbore by comparing parameter measurements of a first zone to parameter measurements of a second zone;

identifying said variations which fall outside said threshold variations; and detecting said leak source based upon said identification, wherein said processor is arranged to calculate an azimuthal angle and a radial distance to said leak source with respect to a position of said logging tool.

2. The logging tool of claim 1 wherein:

said first temperature detector, said first pressure detector, and said first acoustic detector are collocated within a first sensing module.

3. The logging tool of claim 1 wherein:

said first temperature detector is a quartz temperature gauge;

said first pressure detector is a quartz temperature compensated pressure gauge; and said first acoustic detector is a piezoelectric element.

4. The logging tool of claim 1, wherein obtaining said acoustic measurement comprises converting said acoustic measurement into a frequency domain that results in a noise power spectral density parameter.

5. A method for detecting a leak source in a wellbore, comprising:

measuring a first temperature parameter at a first point in said wellbore by a first temperature detector;

measuring a first pressure parameter at said first point by a first pressure detector;

measuring a first acoustic parameter at said first point by a first acoustic detector, said first temperature, pressure and acoustic parameters being first parameter measurements;

measuring second and third acoustic parameters by second and third acoustic detectors located at a same axial position as said first acoustic detector;

calculating an azimuthal angle and a radial distance with respect to a position of said logging tool to said leak source by correlating said first, second, and third acoustic parameters; and correlating said first parameter measurements to identify a leak source, said correlation comprising:

determining expected parameter trends along said wellbore, said parameter trends being a temperature trend, pressure trend, and acoustic trend;

determining threshold variations from said expected parameter trends;

determining variations in said parameter measurements along said wellbore by comparing parameter measurements of a first zone to parameter measurements of a second zone;

identifying said variations which fall outside said threshold variations; and detecting said leak source based upon said identification.

6. The method of claim 5 further comprising:

collocating said first temperature detector, said first pressure detector, and said first acoustic detector within a first sensing module.

7. The method of claim 5 further comprising:

measuring a temperature by a quartz temperature gauge;

measuring a pressure by a quartz temperature compensated pressure gauge;

measuring an acoustic signal by a piezoelectric element; and converting said acoustic signal to a frequency domain.

8. The method of claim 5, wherein measuring said first acoustic parameter comprises converting said first acoustic parameter into a frequency domain that results in a noise power spectral density parameter.

9. A logging tool comprising:

a first temperature detector;

a first pressure detector disposed in proximity to said first temperature detector;

a first acoustic detector disposed in proximity to said first temperature detector;

data acquisition circuitry coupled to said first temperature detector, said first pressure detector, and said first acoustic detector;

at least second and third acoustic detectors equally disposed about a first circumference at a same axial position as said first acoustic detector;

at least fourth, fifth, and sixth acoustic detectors equally disposed about a second circumference at a different axial position from said first acoustic detector; and a processor coupled to said data acquisition circuitry and arranged to correlate a temperature parameter, a pressure parameter, and an acoustic parameter to identify a leak source, said correlation comprising:

determining expected parameter trends along said wellbore, said parameter trends being a temperature trend, pressure trend, and acoustic trend;

determining threshold variations from said expected parameter trends;

obtaining parameter measurements along said wellbore, said parameter measurements being a temperature, pressure and acoustic measurement;

determining variations in said parameter measurements along said wellbore by comparing parameter measurements of a first zone to parameter measurements of a second zone;

identifying said variations which fall outside said threshold variations; and detecting said leak source based upon said identification, wherein said data acquisition circuitry is coupled to at least said second, third, fourth, fifth, and sixth acoustic detectors; and wherein said processor is arranged to calculate an azimuthal angle, a radial distance, and an elevation to said leak source with respect to a position of said logging tool.

10. The logging tool of claim 9 further comprising:

a second temperature detector disposed in proximity to said fourth acoustic detector.

11. The logging tool of claim 9 wherein:

said first temperature detector is a quartz temperature gauge;

said first pressure detector is a quartz temperature compensated pressure gauge; and said first acoustic detector is a piezoelectric element.

12. The logging tool of claim 9, wherein obtaining said acoustic measurement comprises converting said acoustic measurement into a frequency domain that results in a noise power spectral density parameter.

13. A method for detecting a leak source in a wellbore, comprising:

measuring a first temperature parameter at a first point in said wellbore by a first temperature detector;

measuring a first pressure parameter at said first point by a first pressure detector;

measuring a first acoustic parameter at said first point by a first acoustic detector, said first temperature, pressure and acoustic parameters being first parameter measurements;

measuring second and third acoustic parameters by second and third acoustic detectors located at a same axial position as said first acoustic detector;

measuring fourth, fifth, and sixth acoustic parameters by fourth, fifth, and sixth acoustic detectors disposed at a different axial position from said first acoustic detector;

correlating said first parameter measurements to identify a leak source, said correlation comprising:

determining expected parameter trends along said wellbore, said parameter trends being a temperature trend, pressure trend, and acoustic trend;

determining threshold variations from said expected parameter trends;

determining variations in said parameter measurements along said wellbore by comparing parameter measurements of a first zone to parameter measurements of a second zone;

identifying said variations which fall outside said threshold variations; and detecting said leak source based upon said identification; and calculating an azimuthal angle, a radial distance, and an elevation with respect to a position of said logging tool to said leak source by correlating said first, second, third, fourth, fifth, and sixth acoustic parameters.

14. The method of claim 13 further comprising:

measuring a second temperature parameter by a second temperature detector disposed in proximity to said fourth acoustic detector.

15. The method of claim 13 further comprising:

disposing a second temperature detector in proximity to said fourth acoustic detector.

16. The method of claim 13 further comprising:

measuring a temperature by a quartz temperature gauge;

measuring a pressure by a quartz temperature compensated pressure gauge;

measuring an acoustic signal by a piezoelectric element; and converting said acoustic signal to a frequency domain.

17. The method of claim 13, wherein measuring said first acoustic parameter comprises converting said first acoustic parameter into a frequency domain that results in a noise power spectral density parameter.

* * * * *